US010982691B2

(12) United States Patent
Kim et al.

(10) Patent No.: US 10,982,691 B2
(45) Date of Patent: Apr. 20, 2021

(54) SYSTEM AND METHOD FOR CONTROLLING CONSTRUCTION MACHINE

(71) Applicant: DOOSAN INFRACORE CO., LTD., Incheon (KR)

(72) Inventors: Chang-mook Kim, Seongnam-si (KR); Woo-yong Jung, Seoul (KR); Hyeon-sik Ahn, Seoul (KR); Ki-yong Kim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 25 days.

(21) Appl. No.: 16/329,613

(22) PCT Filed: Aug. 31, 2017

(86) PCT No.: PCT/KR2017/009555
§ 371 (c)(1),
(2) Date: Feb. 28, 2019

(87) PCT Pub. No.: WO2018/044099
PCT Pub. Date: Mar. 8, 2018

(65) Prior Publication Data

US 2019/0234050 A1 Aug. 1, 2019

(30) Foreign Application Priority Data

Aug. 31, 2016 (KR) ..... 10-2016-0111401

(51) Int. Cl.
*F15B 11/16* (2006.01)

(52) U.S. Cl.
CPC ..... *F15B 11/162* (2013.01)

(58) Field of Classification Search
CPC .. F15B 11/162; F15B 11/17; F15B 2211/6355
See application file for complete search history.

(56) References Cited

U.S. PATENT DOCUMENTS 5,249,421 A 10/1993 Lunzman
5,490,384 A * 2/1996 Lunzman ..... E02F 9/2221 60/327

(Continued)

FOREIGN PATENT DOCUMENTS

EP 0908564 A2 4/1999
JP S58-113605 A 7/1983

(Continued)

OTHER PUBLICATIONS

Office Action issued for corresponding Japanese Patent Application No. 2019-512003 dated Feb. 3, 2020, along with a machine translation.

(Continued)

*Primary Examiner* — F Daniel Lopez
(74) *Attorney, Agent, or Firm* — Hauptman Ham, LLP

(57) ABSTRACT

A control system for construction machinery, includes a hydraulic pump, first and second actuators connected to the hydraulic pump through first and second parallel lines respectively, first and second control valves installed in the first and second parallel lines respectively and configured to control operations of the first and second actuators, first and second spool displacement adjusting valves configured to control displacement amounts of the spools of the first and second control valves, and a controller configured to output a control signal to the first and second spool displacement adjusting valves corresponding to a manipulation signal of an operator, and configured to limit a spool displacement amount of the second control valve according to the manipulation signal for the first actuator when the manipulation signal for a multiple operation of the first and second actuators is received.

15 Claims, 7 Drawing Sheets

(56) References Cited

U.S. PATENT DOCUMENTS

| | | | | |
|---|---|---|---|---|
| 6,050,090 | A | 4/2000 | Tohji | |
| 6,321,152 | B1 * | 11/2001 | Amborski | E02F 9/2221 60/422 |
| 8,899,034 | B2 * | 12/2014 | Ballweg | F15B 11/162 60/424 |
| 10,519,628 | B2 * | 12/2019 | Kim | E02F 9/2235 |
| 2003/0172650 | A1 * | 9/2003 | Konishi | F15B 11/162 60/421 |
| 2009/0084192 | A1 | 4/2009 | Budde et al. | |

FOREIGN PATENT DOCUMENTS

| | | | |
|---|---|---|---|
| JP | 05-017202 | U | 3/1993 |
| JP | H9-221783 | A | 8/1997 |
| JP | 10-072850 | A | 3/1998 |
| JP | H11-71788 | A | 3/1999 |
| JP | 2003-232303 | A | 8/2003 |
| JP | 3767914 | B2 | 2/2006 |
| JP | 2009-92214 | A | 4/2009 |
| JP | 2011-236942 | A | 11/2011 |
| JP | 2014-529050 | A | 10/2014 |
| KR | 10-2013-0143552 | A | 12/2013 |
| KR | 10-2014-0034833 | A | 3/2014 |
| KR | 10-2015-0104113 | A | 9/2015 |

OTHER PUBLICATIONS

International Search Report for PCT/KR2017/009555 dated Dec. 7, 2017.

European Search Report dated Jun. 4, 2020, in connection with corresponding International Patent Application No. PCT/KR2017/009555.

* cited by examiner

SYSTEM AND METHOD FOR CONTROLLING CONSTRUCTION MACHINE

CROSS REFERENCE TO RELATED APPLICATION

This present application is a national stage filing under 35 U.S.C § 371 of PCT application number PCT/KR2017/009555 filed on Aug. 31, 2017 which is based upon and claims the benefit of priority to Korean Patent Application No. 10-2016-0111401 filed on Aug. 31, 2016 in the Korean Intellectual Property Office. The disclosures of the above-listed applications are hereby incorporated by reference herein in their entirety.

TECHNICAL FIELD

The present invention relates to a control system for construction machinery and a control method for construction machinery. More particularly, the present invention relates to a control system for construction machinery including an electro-hydraulic main control valve using an electro proportional pressure reducing valve and a control method for construction machinery using the same.

BACKGROUND ART

Recently, in construction machinery, an electro-hydraulic main control valve with an electro proportional pressure reducing valve (EPPRV) may be used. In construction machinery including a hydraulic main control valve, when a multiple operation of actuators having different working pressures is performed, an orifice structure may be installed in a hydraulic line to adjust balance in flow distribution between the actuators.

However, inefficient flow distribution and deterioration in controllability may occur due to a fixed orifice area in the orifice structure, and when a relatively great load is exerted on the actuator, fuel efficiency may be decreased due to pressure loss.

DISCLOSURE OF THE INVENTION

Problemes to be Solved

An object of the present invention provides a control system for construction machinery capable of improving fuel efficiency and controllability.

Another object of the present invention provides a control method for construction machinery using the above control system.

Means to Solve the Problems

According to example embodiments, a control system for construction machinery, includes a hydraulic pump, first and second actuators connected to the hydraulic pump through first and second parallel lines respectively and operable by a working oil discharged from the hydraulic pump, first and second control valves installed in the first and second parallel lines respectively and configured to control operations of the first and second actuators, first and second spool displacement adjusting valves configured to supply a pilot signal pressure to spools of the first and second control valves in proportion to an inputted control signal to control displacement amounts of the spools of the first and second control valves, and a controller configured to output the control signal to the first and second spool displacement adjusting valves corresponding to a manipulation signal of an operator, and configured to limit a spool displacement amount of the second control valve according to the manipulation signal for the first actuator when the manipulation signal for a multiple operation of the first and second actuators is received.

In example embodiments, the controller may output, to the second spool displacement adjusting valve, the control signal which is capable of decreasing a conversion ratio of a spool displacement of the second control valve to the manipulation signal for the second actuator in proportion to a size of the manipulation signal for the first actuator.

In example embodiments, when the manipulation signal for the first actuator is a maximum value, the conversion ratio of the manipulation signal for the second actuator may be decreased to at least 50% of a conversion ratio in a single operation of the second actuator.

In example embodiments, an orifice area of the second control valve may be controlled to be in inverse proportion to the size of the manipulation signal for the first actuator.

In example embodiments, the first and second spool displacement adjusting valves may include an electro proportional pressure reducing valve (EPPRV).

In example embodiments, the controller may include a priority mode determiner to determine whether or not a priority mode where an operation of the first actuator is given to priority to be performed from the manipulation signal for the first and second actuators, a joystick displacement converter to convert an inputted joystick displacement amount for the second actuator to a secondary joystick displacement amount which is decreased in proportion to a joystick displacement for the first actuator, in the priority mode, and an output portion to the control signal corresponding to the converted secondary joystick displacement amount for controlling the second pilot signal.

In example embodiments, the priority determiner may cancel the priority mode when it is determined that a heavy load work where discharge pressures of the hydraulic pump or the working pressures of the first and second actuators are greater than a predetermined pressure range is performed.

In example embodiments, the first and second control valves may be installed sequentially in a center bypass line connected to the hydraulic pump.

In example embodiments, the first actuator may include a boom cylinder and the second actuator may include a bucket cylinder, and the first control valve may include a boom control valve and the second control valve may include a bucket control valve.

In example embodiments, when a working pressure of the first actuator is greater than a working pressure of the second actuator, a priority mode may be determined to be performed.

According to example embodiments, in a control method for construction machinery, a hydraulic system including first and second actuators connected to one hydraulic pump through first and second parallel lines respectively and first and second control valves installed in the first and second parallel lines respectively and configured to control operations of the first and second actuators, is provided. A manipulation signal of an operator for first and second actuators is received. Whether or not a priority mode where an operation of the first actuator is given to priority to be performed is determined from the manipulation signal. A spool displacement amount of the second control valve to the manipulation signal for the second actuator is limited according to the manipulation signal for the first actuator, in the priority mode.

In example embodiments, limiting the spool displacement amount of the second control valve may include decreasing a conversion ratio of the spool displacement of the second control valve to the manipulation signal for the second actuator in proportion to a size of the manipulation signal for the first actuator.

In example embodiments, limiting the spool displacement amount of the second control valve may include, when the manipulation signal for the first actuator is a maximum value, decreasing the conversion ratio of the manipulation signal for the second actuator to at least 50% of a conversion ratio in a single operation of the second actuator.

In example embodiments, limiting the spool displacement amount of the second control valve may include controlling an orifice area of the second control valve to be in inverse proportion to the size of the manipulation signal for the first actuator.

In example embodiments, receiving the manipulation signal of an operator for first and second actuators may include receiving joystick displacement amounts for the first and second actuators, and limiting the spool displacement amount of the second control valve may include converting the inputted joystick displacement amount for the second actuator to a secondary joystick displacement amount which is decreased in proportion to the joystick displacement for the first actuator.

In example embodiments, the control method for construction machinery may further include supplying a pilot signal pressure corresponding to the converted secondary joystick displacement amount to a spool of the second control valve to control a displacement amount of the spool of the second control valve.

In example embodiments, supplying the pilot signal pressure to the spool of the second control valve may include using an electro proportional pressure reducing valve (EP-PRV).

In example embodiments, the control method for construction machinery may further include canceling the priority mode when it is determined that a heavy load work where pressures of the hydraulic pump or the working pressures of the first and second actuators are greater than a predetermined pressure range.

In example embodiments, the first actuator may include a boom cylinder and the second actuator may include a bucket cylinder, and the first control valve may include a boom control valve and the second control valve may include a bucket control valve In example embodiments, determining whether or not the priority mode to be performed may include comparing a working pressure of the first actuator and a working pressure of the second actuator.

Effects of the Invention

According to example embodiments, when a multiple operation of first and second actuators having different working pressure is performed, an orifice area of a control valve connected to any one of the first and second actuators which has a relatively low working pressure may be reduced to increase the working pressure for the actuator and to control distribution of the working oil supplied to the first and second actuators.

Accordingly, a conventional orifice structure which is installed for distribution of the working oil in a conventional control system may be removed, to thereby obtain cost saving effects and improved fuel efficiency. Further, inefficient working oil distribution and pressure loss due to a fixed orifice area in the conventional orifice structure may be prevented, and a meter-in control may be performed according to a load exerted on the actuator and the joystick displacement amount, to thereby improve fuel efficiency and controllability.

However, the effect of the invention may not be limited thereto, and may be expanded without being deviated from the concept and the scope of the present invention.

BEST MODE FOR CARRYING OUT THE INVENTION

Figure 1:
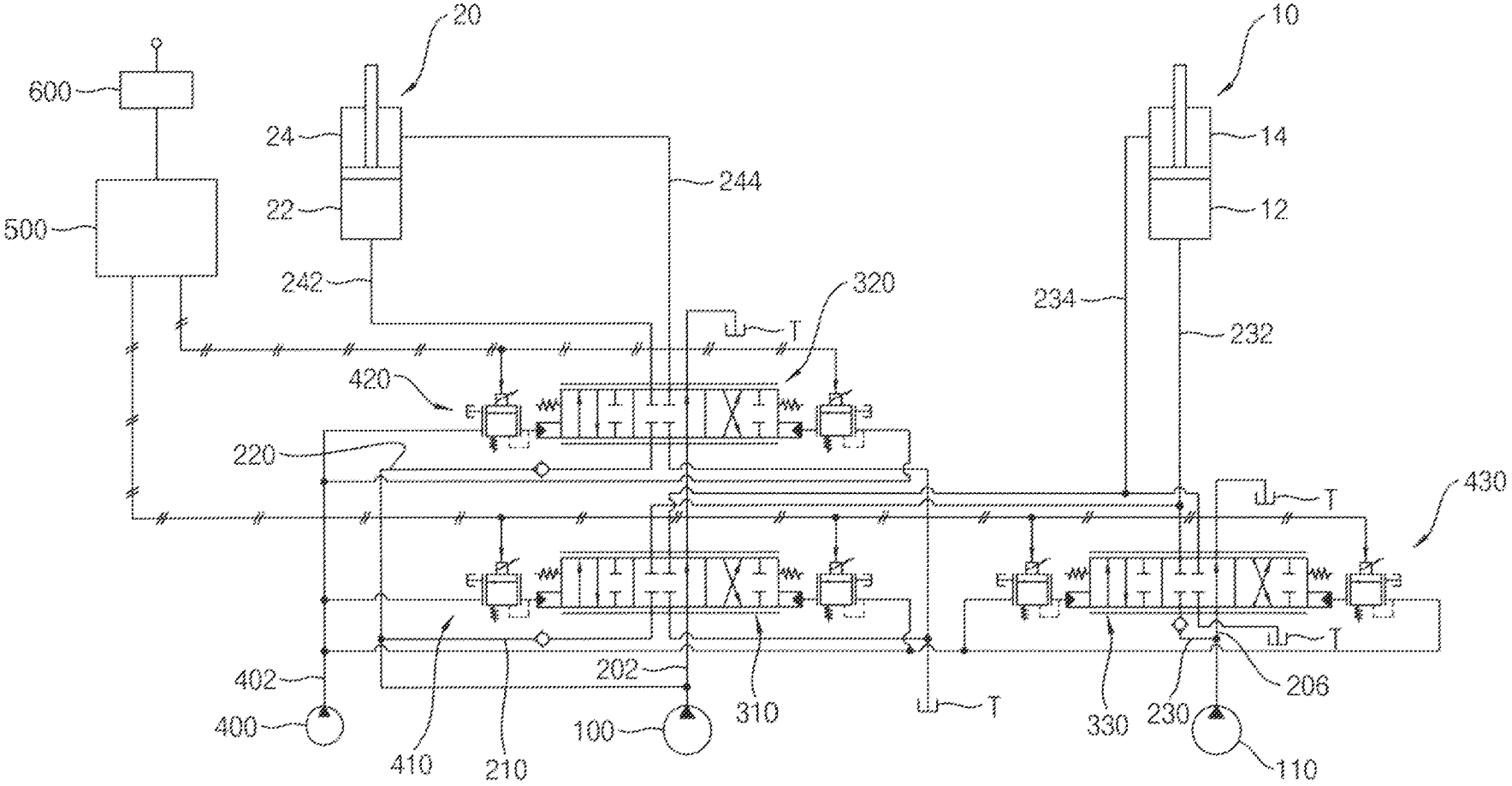
FIG. 1 is a hydraulic circuit diagram illustrating a control system for construction machinery in accordance with example embodiments.

Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferable embodiments of the present invention will be explained in detail with reference to the accompanying drawings. Like numerals refer to like elements throughout example embodiments, and any further repetitive explanation concerning the similar elements will be omitted.

Figure 2:
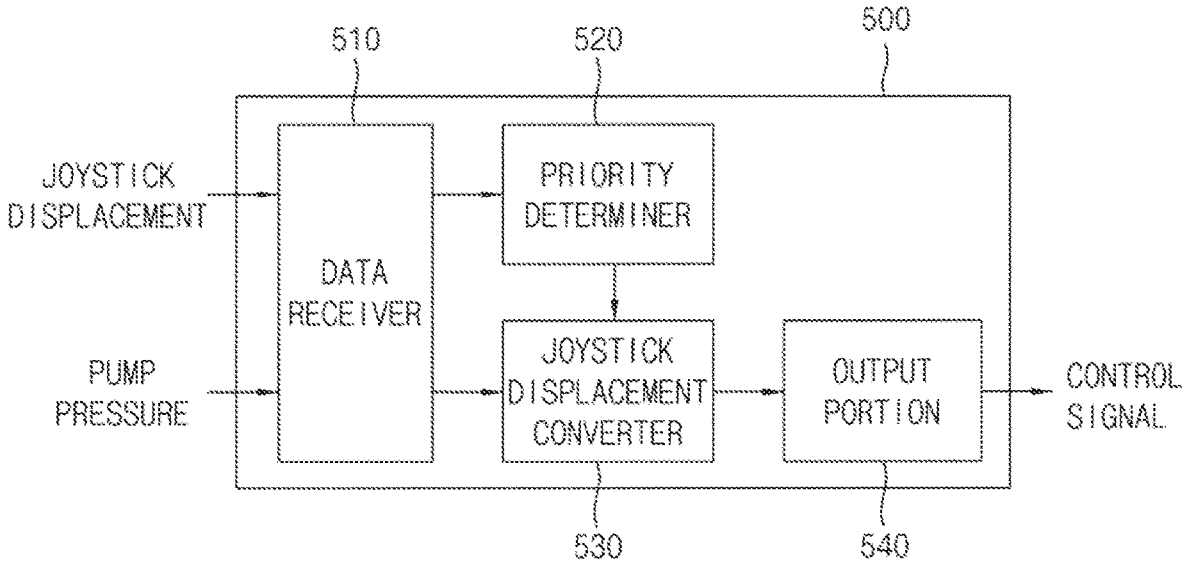
FIG. 2 is a block diagram illustrating a controller of the control system in FIG. 2.
Figure 3:
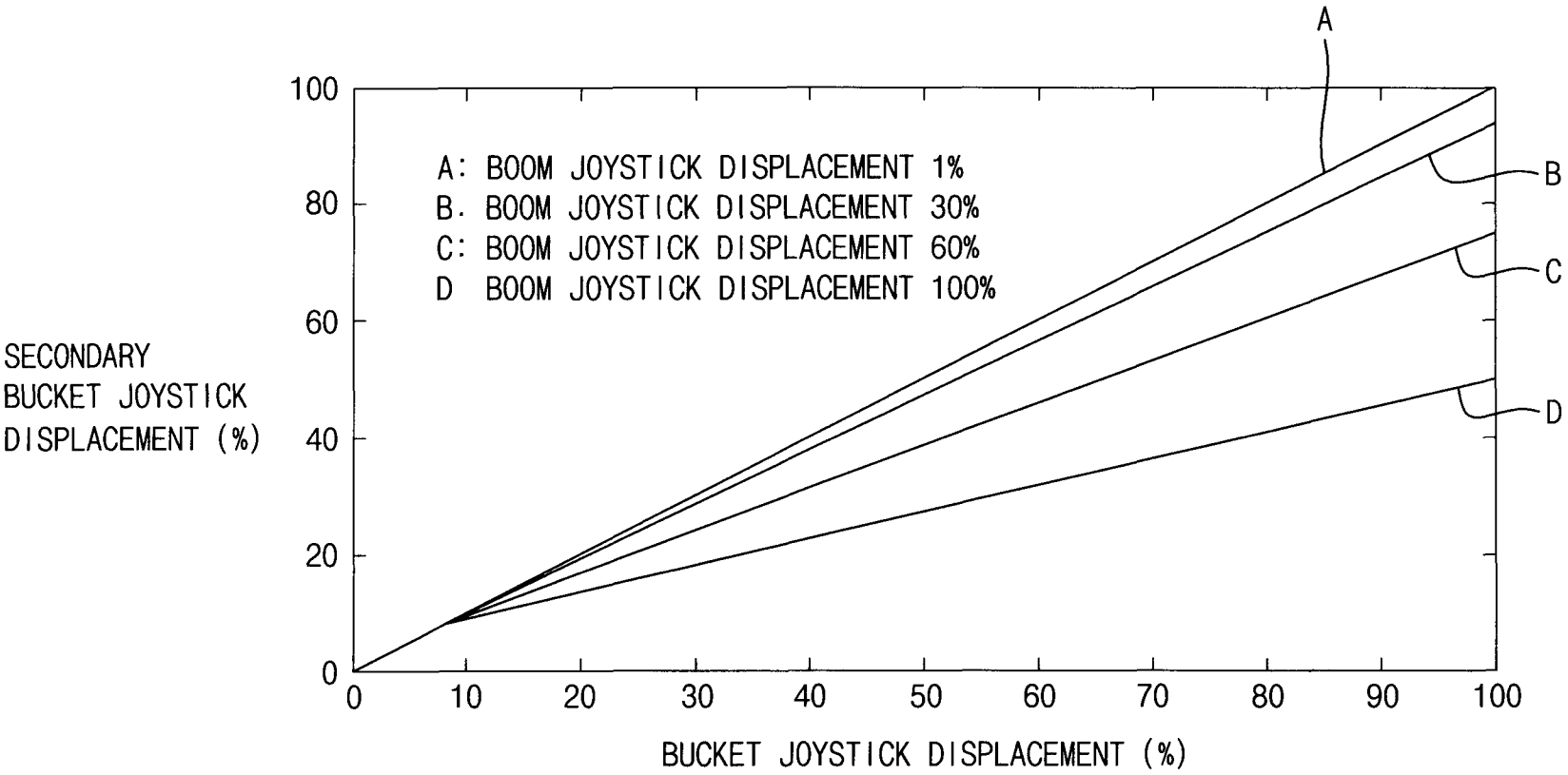
FIG. 3 is a graph illustrating a bucket joystick displacement limit map according to a boom joystick displacement in a boom priority mode, which is stored in the controller in FIG. 2.
Figure 4:
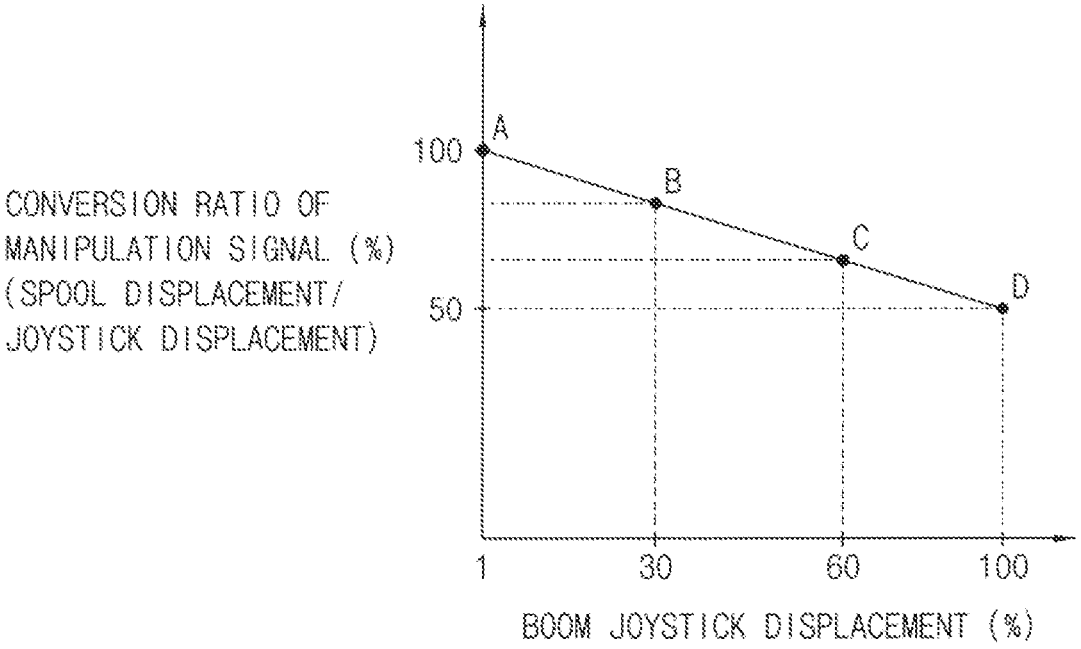
FIG. 4 is a graph illustrating a conversion ratio of a bucket joystick displacement according to the bucket joystick displacement limit map in FIG. 3.
Figure 5:
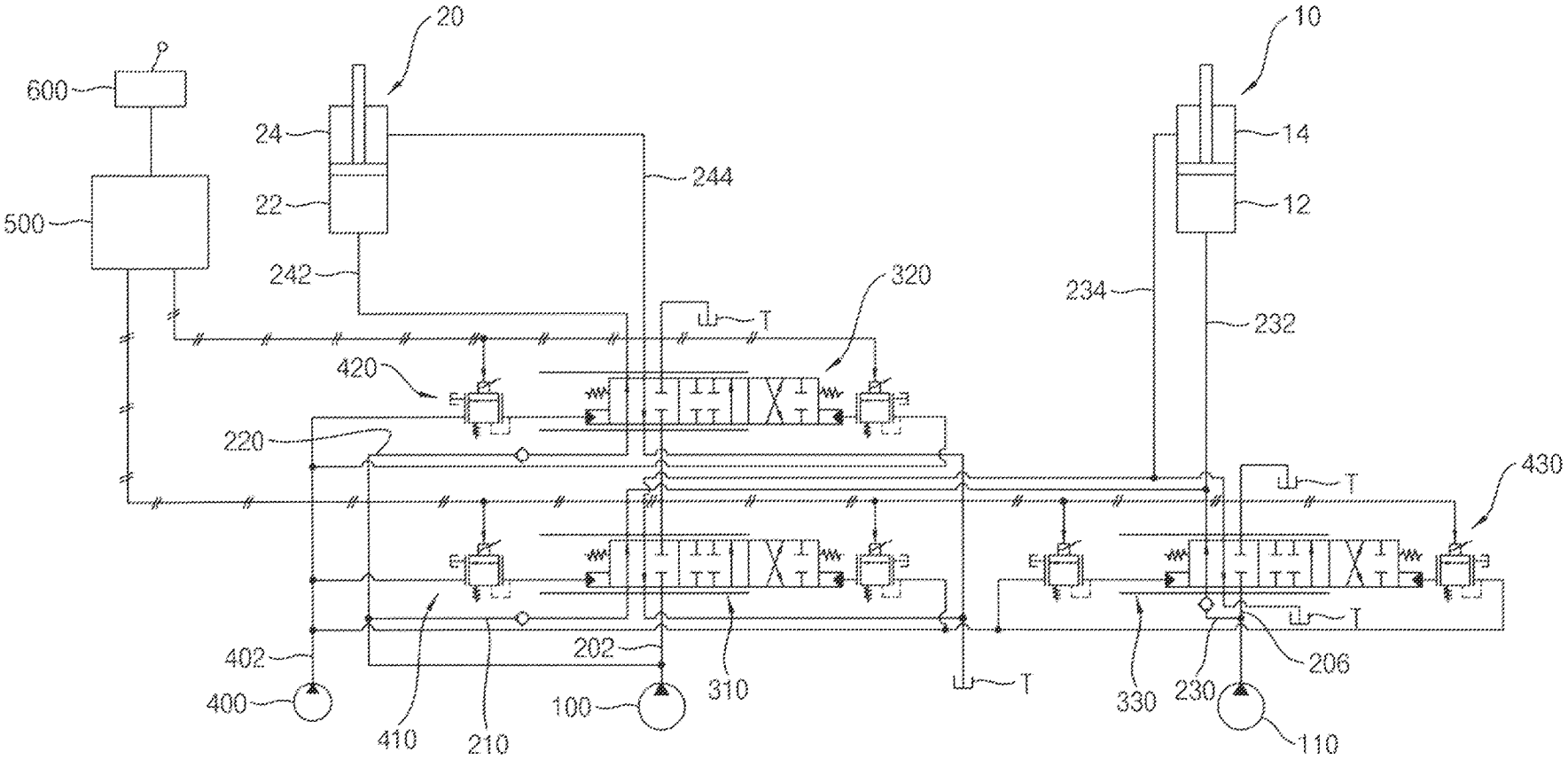
FIG. 5 is a hydraulic circuit diagram illustrating the control system in FIG. 1 where a multiple operation signal of boom up operation and bucket crowd operation is received.

FIG. 1 is a hydraulic circuit diagram illustrating a control system for construction machinery in accordance with example embodiments. FIG. 2 is a block diagram illustrating a controller of the control system in FIG. 2. FIG. 3 is a graph illustrating a bucket joystick displacement limit map according to a boom joystick displacement in a boom priority mode, which is stored in the controller in FIG. 2. FIG. 4 is a graph illustrating a conversion ratio of a bucket joystick displacement according to the bucket joystick displacement limit map in FIG. 3. FIG. 5 is a hydraulic circuit diagram illustrating the control system in FIG. 1 where a multiple operation signal of boom up operation and bucket crowd operation is received.

Referring to FIGS. 1 to 5, a control system for construction machinery may include a first hydraulic pump 100, first and second actuators 10 and 20 connected to the first hydraulic pump 100 through first and second parallel lines 210 and 220 respectively and operable by a working oil discharged from the first hydraulic pump 100, first and second control valves 310 and 320 installed in the first and second parallel lines 210 and 220 respectively and configured to control operations of the first and second actuators 10 and 20, a first spool displacement adjusting valve 410 and a second spool displacement adjusting valve 420 supplying pilot signal pressures to spools of the first and second control valves 310 and 320 respectively in proportion to an inputted control signal to control displacement amounts of the spools of the first and second control valves 310 and 320, and a controller 500 configured to output the control signal to each of the first and second spool displacement adjusting valves 410, 420 corresponding to a manipulation signal of an operator and configured to adjust the displacement amounts of the spools in order to control the operation of one of the first and second actuators 10 and 20 according to the manipulation signal of the other of the first and second actuators 10 and 20.

In example embodiments, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

The construction machinery may include a lower travelling body, an upper swinging body mounted to be capable of swinging on the lower travelling body, and a cabin and a front working device installed in the upper swinging body. The front working device may include a boom, an arm and a bucket. A boom cylinder for controlling a movement of the boom may be installed between the boom and the upper swinging body. An arm cylinder for controlling a movement of the arm may be installed between the arm and the boom. A bucket cylinder for controlling a movement of the bucket may be installed between the bucket and the arm. As the boom cylinder, the arm cylinder and the bucket cylinder may expand or contract, the boom, the arm and the bucket may implement various movements, to thereby perform various works.

In example embodiments, the first hydraulic pump 100 may be connected to an engine (not illustrated) through a power take off (PTO) such that a power of the engine may be transferred to the first hydraulic pump 100. The working oil discharged from the first hydraulic pump 100 may be supplied to the first and second actuators 10 and 20 through the first and second control valves 310 and 320 respectively.

In particular, the first and second control valves 310 and 320 may be connected to the first hydraulic pump 100 through a first main hydraulic line 200. The first main hydraulic line 200 may be divided into a first center bypass line 202 and the first and second parallel lines 210 and 220. The first and second control valves 310, 320 may be installed sequentially in the first center bypass line 202.

The first and second control valves 310 and 320 may be installed respectively in the first and second parallel lines 210 and 220 which are connected to the first hydraulic pump 100 in parallel with each other. Even through the first control valve 310 is switched to close the first center bypass line 202, the second control valve 320 may be connected to the first hydraulic pump 100 by the second parallel line 220 such that the working oil from the first hydraulic pump 100 may be supplied to the first hydraulic pump 100. Accordingly, when the first and second control valves 310 and 320 are switched, the working oil from the first hydraulic pump 100 may be supplied to the first and second actuators 10 and 20 through the first and second control valves 310 and 320 respectively.

Although it is not illustrated in the figures, an auxiliary control valve for controlling an operation of a third actuator may be installed in the first center bypass line 202, and the working oil discharged from the first hydraulic pump 100 may be supplied to the third actuator through the auxiliary control valve. In this case, a parallel line similar to the first and second parallel lines 210, 220 may be connected to the auxiliary control vale.

In example embodiments, the first actuator 10 may be the boom cylinder, and the second actuator 20 may be the bucket cylinder. In this case, the first control valve 310 may be a boom control valve, and the second control valve 320 may be a bucket control valve.

The first control valve 310, that is, the boom control valve may be connected to the first actuator 10, that is, a boom head chamber and a boom rod chamber of the boom cylinder through a boom head hydraulic line 232 and a boom rod hydraulic line 234. Accordingly, the first control valve 310 may be switched to selectively supply the working oil discharged from the first hydraulic pump 100 to the boom head chamber 12 and the boom rod chamber 14.

The working oil which drives the boom cylinder 10 may return to a drain tank T through a return hydraulic line. For example, during a boom up operation the working oil from the boom rod chamber 14 may be drained to the drain tank T through the boom rod hydraulic line 234 via the first control valve 310, that is, the boom control valve.

The second control valve 320, that is, the bucket control valve may be connected to the second actuator 20, that is, a bucket head chamber 22 and a bucket rod chamber 24 of the bucket cylinder through a bucket head hydraulic line 242 and a bucket rod hydraulic line 244. Accordingly, the second control valve 320 may be switched to selectively supply the working oil discharged from the first hydraulic pump 100 to the bucket head chamber 22 and the bucket rod chamber 24.

The working oil which drives the bucket cylinder 20 may return to the drain tank T through a return hydraulic line. For example, the working oil from the bucket head chamber 22 and the bucket rod chamber 24 may be drained to the drain tank T through the bucket head hydraulic line 242 and the bucket rod hydraulic line 244 via the second control valve 320, that is, the bucket control valve.

On the other hand, when there is no manipulation signals for the first and second actuators 10, 20, the working oil from the first hydraulic pump 100 may return to the drain tank T through the first center bypass line 202.

In example embodiments, a pilot pump 400 may be connected to an output axis of the engine. As the output axis of the engine rotates, the pilot pump 400 may be driven to discharge a pilot working oil. For example, the pilot pump may include a gear pump. In this case, the working oil and the pilot working oil may include substantially the same material.

The pilot working oil discharged from the pilot pump 400 may be supplied to the spools of the first and second control valves 310, 320 via the first and second spool displacement adjusting valves 410, 420 respectively. The pilot working oil discharged from the pilot pump 400 may be supplied to the first and second spool displacement adjusting valves 410, 420 through a control line 402.

The first and second spool displacement adjusting valves 410, 420 may supply the pilot signal pressures to the spools of the first and second control valves 310, 320 in proportion to the inputted control signal respectively to control the displacement amounts of the spools of the first and second control valve 310, 320.

For example, a pair of the first spool displacement adjusting valves 410 may be provided in both sides of the spool of the first control valve 310. A first pilot signal pressure outputted from the first spool displacement adjusting valve 410 may be supplied selectively to both sides of the spool, to switch the first control valve 310. The first spool displacement adjusting valve 410 may supply the first pilot signal pressure in proportion to the inputted control signal. The movement of the spool of the first control valve 310 may be controlled by the first pilot signal pressure. That is, the movement direction of the spool may be determined by a supply direction of the first pilot signal pressure, and the displacement amount of the spool may be determined by the magnitude of the first pilot signal pressure.

Additionally, a pair of the second spool displacement adjusting valves 420 may be provided in both sides of the spool of the second control valve 320. A second pilot signal pressure outputted from the second spool displacement adjusting valve 420 may be supplied selectively to both sides of the spool, to switch the second control valve 320. The second spool displacement adjusting valve 420 may supply the second pilot signal pressure in proportion to the inputted control signal. The movement of the spool of the second control valve 320 may be controlled by the second pilot signal pressure. That is, the movement direction of the spool may be determined by a supply direction of the second pilot signal pressure, and the displacement amount of the spool may be determined by the magnitude of the second pilot signal pressure.

In example embodiments, the control system for construction machinery may include a main control valve (MCV) as an assembly including the first and second control valves 310 and 320. The main control valve may be an electro-hydraulic main control valve including an electro proportional pressure reducing valve (EPPRV) which controls a pilot working oil supplied to the spool of the control valve according to an inputted electrical signal. The first and second spool displacement adjusting valves 410, 420 may include an electro proportional pressure reducing valve (EPPRV).

The controller 500 may receive the manipulation signal in proportion to a manipulation amount of an operator, and may output a pressure command signal as the control signal to the first and second spool displacement adjusting valves 410, 420 corresponding to the manipulation signal. The electro proportional pressure reducing valves may output a secondary pressure in proportion to the pressure command signal to the corresponding spools, to control the spools using electrical signals.

For example, the controller 500 may receive a manipulation signal for the first actuator 10, for example, a first joystick displacement amount, and generate and apply a control signal corresponding to the first joystick displacement amount, for example, current to the first spool displacement adjusting valve 410. The first spool displacement adjusting valve 410 may supply a first pilot signal pressure in proportion to the applied current to the spool of the first control valve 310 to move the spool according to the supplied first pilot signal pressure. Accordingly, the first joystick displacement amount for the first actuator 10 may be converted into a spool displacement amount of the first control valve 310 at a predetermined conversion ratio.

The controller 500 may receive a manipulation signal for the second actuator 20, for example, a second joystick displacement amount, and generate and apply a control signal corresponding to the second joystick displacement amount, for example, current to the second spool displacement adjusting valve 420. The second spool displacement adjusting valve 420 may supply a second pilot signal pressure in proportion to the applied current to the spool of the second control valve 320 to move the spool according to the supplied second pilot signal pressure. Accordingly, the second joystick displacement amount for the second actuator 20 may be converted into a spool displacement amount of the second control valve 320 at a predetermined conversion ratio.

For example, a manipulation portion 600 may include a joystick, a pedal, etc. When an operator manipulates the manipulation portion 600, a manipulation signal corresponding to the manipulation may be generated. The manipulation portion 600 may include a sensor for detecting the joystick displacement amount (or angle). The manipulation portion 600 may output a signal such as a voltage signal or a current signal corresponding to the detected displacement amount. The controller 500 may receive the manipulation signal and control the main control valve corresponding to the manipulation signal, to operate the first and second actuators.

In example embodiments, the control system for construction machinery may further include a second hydraulic pump 110 for supplying a working oil to the first actuator 10, a third control valve 330 installed in a hydraulic line between the first actuator 10 and the second hydraulic pump 110 and configured to control an operation of the first actuator 10, and a third spool displacement adjusting valve 430 supplying a pilot signal pressure to a spool of the third control valve 330 respectively in proportion to an inputted control signal to control a displacement amount of the spool of the third control valve 312.

In example embodiments, the second hydraulic pump 110 may be connected to the engine. The working oil discharged from the second hydraulic pump 110 may be supplied to the first actuator 10 through the third control valve 330.

In particular, the third control valve 330 may be connected to the second hydraulic pump 110 through a second main hydraulic line 204. The second main hydraulic line 204 may be divided into a second center bypass line 206 and a third parallel line 230. The third control valve 330 and an auxiliary control valve (not illustrated) may be sequentially installed in the second center bypass line 206.

The third control valve 330 may be connected to the first actuator 10, that is, the boom head chamber 12 and the boom head chamber 14 of the boom cylinder through the boom head hydraulic line 232 and the boom rod hydraulic line 234. Accordingly, the third control valve 330 may be switched to selectively supply the working oil discharged from the second hydraulic pump 110 to the boom head chamber 12 and the boom rod chamber 14. Thus, the working oil discharged from the first and second hydraulic pumps 100, 110 may be joined through the first and third control valves 310, 330 to be supplied to the first actuator 10. In case that the first actuator 10 performs a heavy load work, the working oil discharged from the first and second hydraulic pumps 100, 110 may be joined.

In case that there is no manipulation signal for the first actuator 10, the working oil discharged from the second hydraulic pump 110 may return to the drain tank T.

The pilot working oil discharged from the pilot pump 400 may be supplied to a spool of the third control valve 320 via the third spool displacement adjusting valve 430. The pilot working oil discharged from the pilot pump 400 may be supplied to the third spool displacement adjusting valve 430 through the control line 402.

The third spool displacement adjusting valve 430 may supply the pilot signal pressure to the spool of the third control valve 330 in proportion to the inputted control signal to control the displacement amount of the spool of the third control valve 320.

For example, a pair of the third spool displacement adjusting valves 430 may be provided in both sides of the spool of the third control valve 330. A third pilot signal pressure outputted from the third spool displacement adjusting valve 430 may be supplied selectively to both sides of the spool, to switch the third control valve 330. The third spool displacement adjusting valve 430 may supply the third pilot signal pressure in proportion to the inputted control signal. The movement of the spool of the third control valve 330 may be controlled by the third pilot signal pressure. That is, the movement direction of the spool may be determined by a supply direction of the third pilot signal pressure, and the displacement amount of the spool may be determined by the magnitude of the third pilot signal pressure.

In example embodiments, the third spool displacement adjusting valve 430 may include an electro proportional pressure reducing valve (EPPRV).

The controller 500 may receive a manipulation signal for the first actuator 10, for example, a joystick displacement amount, and generate and apply a control signal corresponding to the first joystick displacement amount, for example, current to the third spool displacement adjusting valve. The third spool displacement adjusting valve 430 may supply the third pilot signal pressure in proportion to the applied current to the spool of the third control valve 330 to move the spool according to the supplied third pilot signal pressure. Accordingly, the joystick displacement amount for the first actuator 10 may be converted into a spool displacement amount of the third control valve 330 at a predetermined conversion ratio.

In example embodiments, when the controller 500 receives a manipulation signal for a multiple operation of the first and second actuators 10, 20, the controller 500 may control to limit the spool displacement amount of the second control valve 320 in response to the manipulation signal for the second actuator 20 based on the manipulation signal for the first actuator 10. The controller 500 may output a control signal which is decreased in proportion to the amount of the manipulation signal for the first actuator 10, to the second spool displacement adjusting valve 420. Accordingly, the conversion ratio of the manipulation signal for the second actuator 20, that is, a ratio of the spool displacement amount of the second control valve 320 with respect to the joystick displacement amount for the second actuator 20 may be decreased in proportion to the joystick displacement amount for the first actuator 10.

As illustrated in FIG. 2, the controller 500 may include a data receiver 510, a priority mode determiner 520, a joystick displacement converter 530 and an output portion 540.

The data receiver 510 may receive a joystick displacement from the manipulation portion 600. The data receiver 510 may receive the joystick displacement amount as a manipulation signal for the boom, the arm, the bucket, etc. For example, referring to FIG. 7, at S200, the data receiver 510 may receive a boom joystick displacement amount (boom stroke) as the manipulation signal for the boom cylinder and a bucket joystick displacement amount (bucket stroke) as the manipulation signal for the bucket cylinder. Additionally, the data receiver 510 may receive discharge pressure values of the first and second hydraulic pumps 100 and 110. The data receiver 510 may receive pressure values of the actuators.

Figure 7:
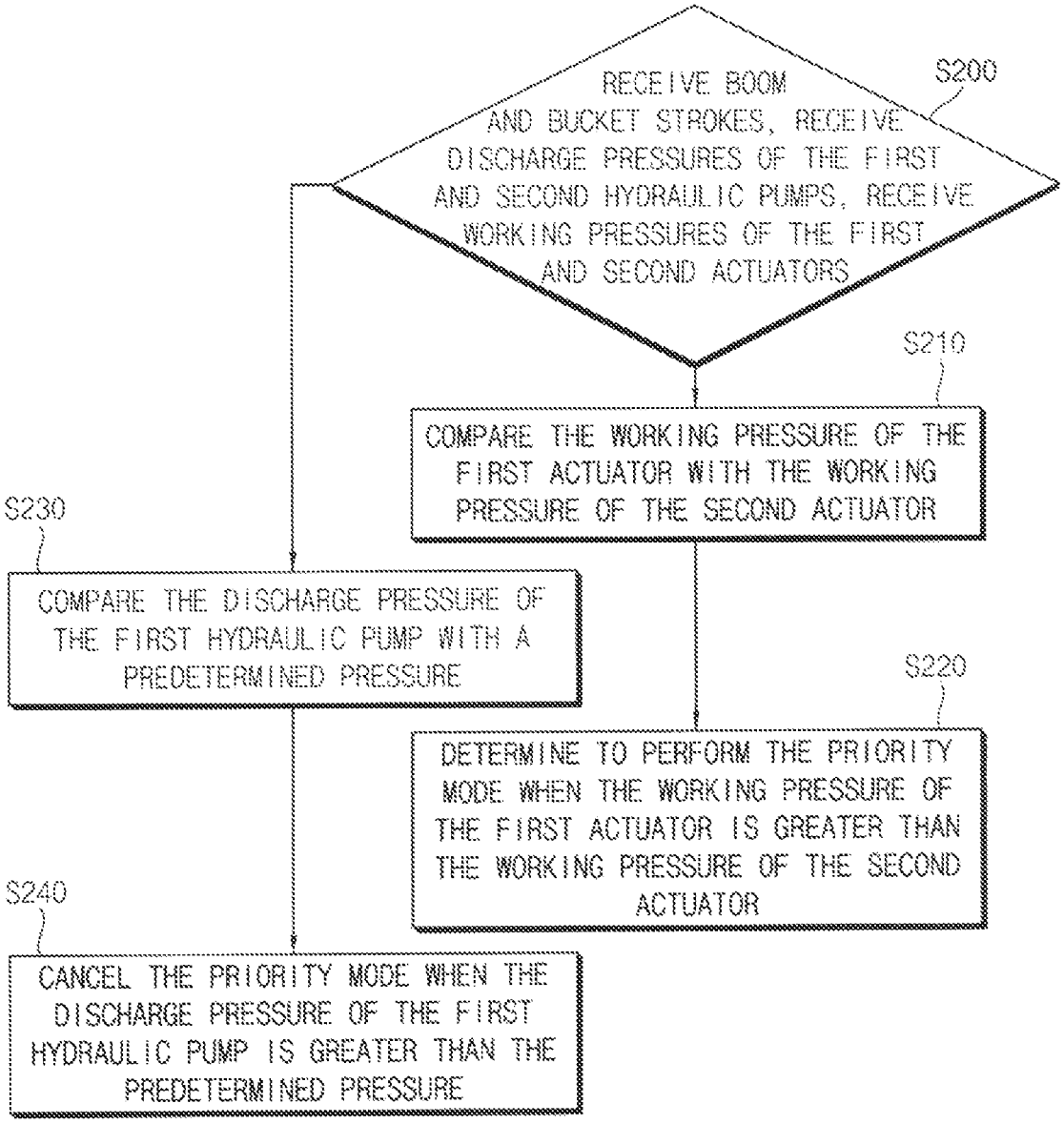
FIG. 7 is a flow chart illustrating the functions of the priority determiner in accordance with at least one example embodiment.

The priority determiner 520 may determine whether or not a priority mode where an operation of the first actuator 10 is given to priority from inputted joystick displacement amounts for the first and second actuator 10, 20 to be performed. Referring to FIG. 7, when the boom joystick displacement amount and the bucket joystick displacement amount are received (S200), the priority mode determiner 520 may compare a working pressure of the first actuator 10 and a working pressure of the second actuator 20 (S210) and determine to perform the priority mode when it is determined that the working pressure of the first actuator 10 is greater than the working pressure of the second actuator 20 (S220). The priority determiner 520 may determine to cancel the priority mode (S240) when it is determined that the discharge pressure of the first hydraulic pump 100 is greater than a predetermined pressure, that is, a heavy load work (S230).

When a single operation of the bucket is performed, the discharge pressure of the first hydraulic pump 100 may be about 80 bar. When a single operation of the boom is performed, the discharge pressure of the discharge pressure of the first hydraulic pump 100 may be about 130 bar. On the other hand, when the bucket performs an excavation operation, the discharge pressure of the first hydraulic pump 100 may be increased to a pressure the same as or similar to the working pressure of the boom.

For example, while the bucket operates at a working pressure of about 80 bar, when the boom operates (when a manipulation signal for a multiple operation of the boom and the bucket is received), if the working pressure of the boom cylinder is greater than the working pressure of the bucket cylinder, a boom priority mode may be determined to be performed. The priority determiner 520 may determine to perform the boom priority mode when it is determined that the discharge pressure of the first hydraulic pump 100 is less than a predetermined second pressure (for example, about 180 bar). On the other hand, during the multiple operation of the boom and the bucket, when it is determined that the discharge pressure of the first hydraulic pump 100 is greater than the second pressure, the priority determiner 520 may determine that a heavy load work is operated and cancel the boom priority mode. During the single operation of the bucket, when it is determined that the discharge pressure of the first hydraulic pump 100 is greater than a predetermined first pressure (for example, about 130 bar or 180 bar), the priority determiner 520 may determine that a heavy load work is operated, and then, may output the control signal which corresponds to an originally inputted value (bucket joystick displacement amount), to the second spool displacement adjusting valve 420, without adjusting the inputted bucket joystick displacement amount.

The joystick displacement converter 530 may convert the inputted joystick displacement amount for the second actuator 20 into a secondary joystick displacement amount having a value which is decreased in proportion to the joystick displacement amount for the first actuator 10, while the priority mode operates.

As illustrated in FIG. 3, the joystick displacement converter 530 may calculate a secondary bucket joystick displacement amount (converted bucket stroke) from the inputted bucket joystick displacement amount (bucket stroke) using a displacement limit map, during the priority mode. The inputted bucket joystick displacement amount may be converted into the secondary bucket joystick displacement amount at a predetermined ratio according to the boom joystick displacement amount stored in the displacement limit map. The decreasing rate of the secondary joystick displacement amount with respect to the inputted bucket joystick displacement amount may be proportional to the boom joystick displacement amount (boom stroke). That is, as the boom stroke is increased, the converted secondary bucket joystick displacement amount may be decreased.

The output portion 540 may output the control signal for controlling the pilot signal pressure in proportion to the converted (limited) secondary joystick displacement amount. The output portion 540 may generate and apply current in proportion to the converted secondary joystick displacement amount to the second spool displacement adjusting valve 420. The second spool displacement adjusting valve 420 may supply the pilot signal pressure in proportion to the applied current to the spool of the second control valve 320 to move the spool of the second control valve 320 corresponding to the pilot signal pressure.

Accordingly, in the boom priority mode, an orifice area of the bucket control valve may be controlled to be in inverse proportion to the size of the manipulation signal for the boom. That is, the orifice area of the bucket control valve according to the converted secondary bucket joystick displacement amount may be controlled to be less than the orifice area of the bucket control valve according to the secondary bucket joystick displacement amount in the single operation of the bucket, and the decreasing ratio of the orifice area may be in proportion to the size of the manipulation signal for the boom.

As illustrated in FIG. 4, as the secondary bucket joystick displacement amount is adjusted, the spool displacement amount for the manipulation signal of the bucket control valve may be adjusted. The conversion ratio of the spool displacement amount of the bucket control valve to the bucket manipulation signal (conversion ratio of the bucket manipulation signal) may be decreased in proportion to the size of the boom stroke. The conversion ratio of the bucket manipulation signal in the boom priority signal may be less than the conversion ratio of the bucket manipulation signal in the single operation of the bucket. For example, when the boom stroke is 100%, the conversion ratio of the spool displacement amount of the bucket control valve to the bucket joystick displacement amount may be decreased to about 50% of the conversion ratio in the single operation of the bucket.

As mentioned above, the control system for construction machinery may include first and second control valves configured to control operations of first and second actuators and the electro-hydraulic main control valve having electro proportional pressure reducing valves which control a pilot working oil supplied to spools of the first and second control valves corresponding to an inputted electrical signal. the control system for construction machinery may reduce an orifice area of the control valve connected to any one of the first and second actuators which has a relatively low working pressure when a multiple operation of the first and second actuators having different working pressures is performed, such that the relatively low working pressure may be increased to control distribution of the working oil supplied to the first and second actuators.

Accordingly, instead of a conventional orifice structure which is installed for distribution of a working oil in a control system having a conventional hydraulic main control valve, same or similar functions may be performed in the control system having the electro-hydraulic main control valve, to thereby obtain cost saving effects and improved fuel efficiency. Further, inefficient working oil distribution and pressure loss due to a fixed orifice area in the conventional orifice structure may be prevented, and a meter-in control may be performed according to a load exerted on the actuator and the size of the joystick displacement amount, to thereby improve fuel efficiency and controllability.

Hereinafter, a control method for construction machinery using the control system in FIG. 1 will be explained.

Figure 6:
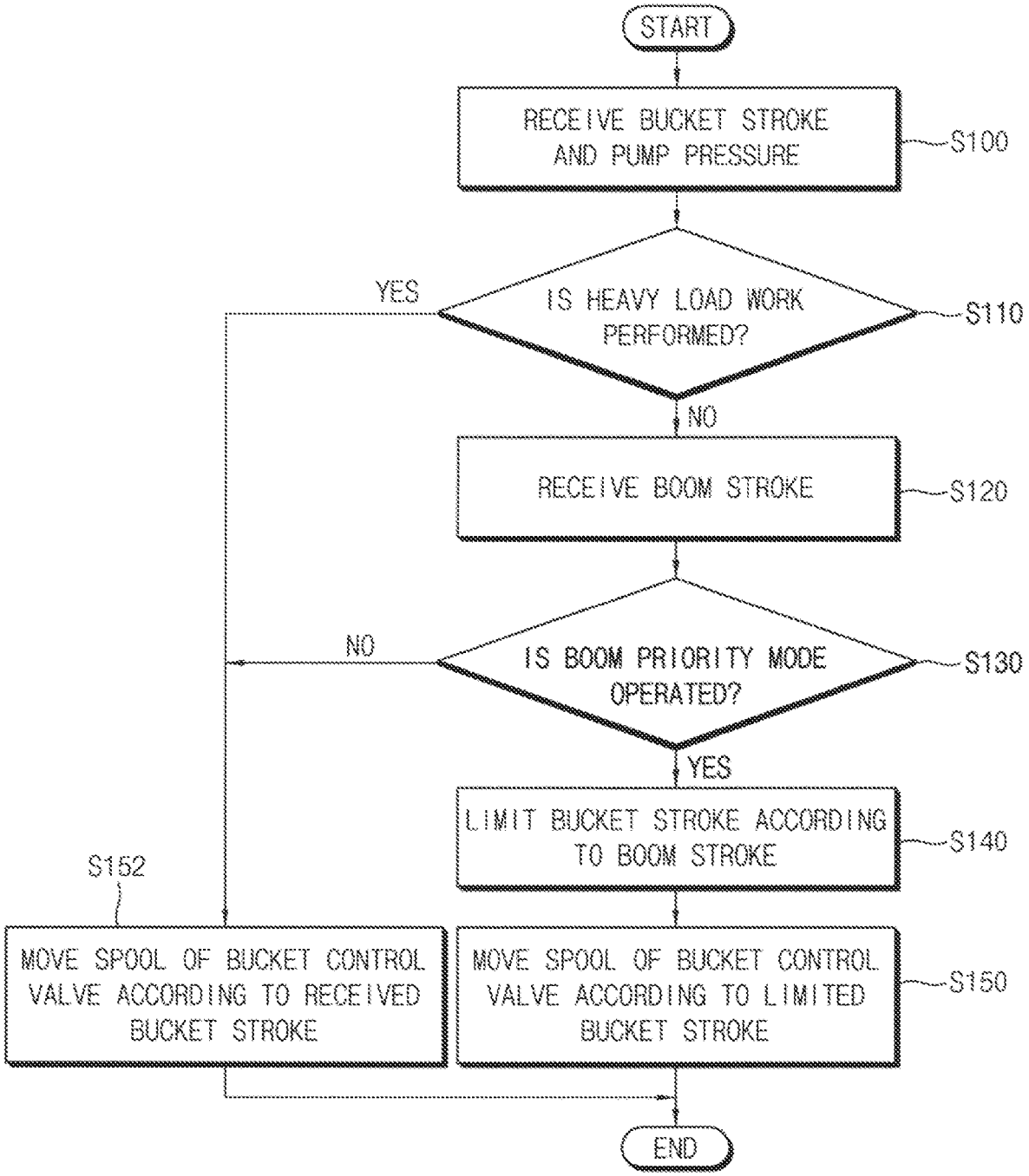
FIG. 6 is a flow chart illustrating a control method for construction machinery in accordance with example embodiments.

FIG. 6 is a flow chart illustrating a control method for construction machinery in accordance with example embodiments.

Referring to FIGS. 1, 2 and 6, a manipulation signal of an operator for first and second actuators 10 and 20 and a discharge pressure of a first hydraulic pump 100 may be received (S100, 120). Whether or not a heavy load work is performed by the first and second actuators 10, 20 may be determined (S110).

In example embodiments, a boom joystick displacement amount (boom stroke) as the manipulation signal for a boom cylinder and a bucket joystick displacement amount (bucket stroke) as the manipulation signal for a bucket cylinder may be received. The discharge pressures of the first hydraulic pump 100 and the second hydraulic pump 110 may be received. Alternatively, pressures of the boom cylinder and the arm cylinder may be received.

In example embodiments, while a single operation of the bucket is performed, the discharge pressure of the first hydraulic pump 100 may be received. If the discharge pressure of the first hydraulic pump 100 is greater than a predetermined first pressure (for example, 130 bar), it may be determined that the heavy load work is performed (S110). In this case, an inputted joystick displacement amount for the bucket (bucket stroke) may not be converted and a control signal (current) corresponding to the originally inputted value may be outputted to a second spool displacement adjusting valve 420, and then, the second spool displacement adjusting valve 420 may supply a second pilot signal pressure in proportion to the applied current to a spool of a second control valve 320 to move a spool of the second control valve 320 corresponding to the second pilot signal pressure (S152).

Then, whether or not a priority mode where an operation of the first actuator 10 is given to priority to be performed may be determined from the manipulation signal (S130).

In example embodiments, while the bucket operates, when the manipulation for the boom is received, whether or not the priority mode to be performed may be determined. When the manipulation signal for a multiple operation of the boom and the bucket is received, the priority mode may be determined to be performed if the working pressure of the boom cylinder is greater than the working pressure of the bucket cylinder. For example, if the discharge pressure of the first hydraulic pump 100 is greater than the first pressure (for example, about 130 bar) and less than a predetermined second pressure (for example, about 180 bar), the priority mode may be determined to be operated.

Then, in the priority mode, the inputted manipulation signal for the second actuator 20 may be limited according to the manipulation signal for the first actuator 10 (S140). In the priority mode, the inputted joystick displacement amount for the second actuator 20 may be adjusted to a secondary joystick displacement amount which is decreased in proportion to the joystick displacement for the first actuator 10.

In example embodiments, a secondary bucket joystick displacement amount (converted bucket stroke) may be calculated from an inputted bucket joystick displacement amount (bucket stroke) using a displacement limit map. The inputted bucket joystick displacement amount may be converted into the secondary bucket joystick displacement amount at a predetermined ratio which varies according to the boom joystick displacement amount stored in the displacement limit map. The decreasing rate of the secondary joystick displacement amount with respect to the inputted bucket joystick displacement amount may be proportional to the boom joystick displacement amount (boom stroke). That is, as the boom stroke is increased, the converted secondary bucket joystick displacement amount may be decreased.

Then, the spool of the second control valve 320 may be moved according to the limited manipulation signal for the second actuator 20 (S150).

In example embodiments, a control signal (current) corresponding to the limited bucket joystick displacement amount may be outputted to the second spool displacement adjusting valve 420, and then, the second spool displacement adjusting valve 420 may supply the second pilot signal pressure in proportion to the applied current to the spool of the second control valve 320 to move the spool of the second control valve 320 corresponding to the second pilot signal pressure.

As the bucket joystick displacement amount is adjusted, the spool displacement amount for the manipulation signal of the bucket control valve may be adjusted. That is, the conversion ratio of the spool displacement amount of the bucket control valve to the bucket manipulation signal (conversion ratio of the bucket manipulation signal) may be decreased in proportion to the size of the boom stroke. The conversion ratio of the bucket manipulation signal in the boom priority signal may be less than the conversion ratio of the bucket manipulation signal in the single operation of the bucket. For example, when the boom stroke is 100%, the conversion ratio of the spool displacement amount of the bucket control valve to the inputted bucket joystick displacement amount may be decreased to about 50% of the conversion ratio in the single operation of the bucket.

As mentioned above, an orifice area of the control valve connected to the bucket cylinder which has a relatively low working pressure when a multiple operation of the boom and the bucket having different working pressures is performed may be reduced to increase the working pressure for the bucket and control distribution of the working oil supplied to the boom cylinder and the bucket cylinder.

Thus, a meter-in control for the bucket may be performed according to loads exerted on the boom and the bucket and the boom joystick displacement amount, to thereby improve fuel efficiency and controllability.

The present invention has been explained with reference to preferable embodiments, however, those skilled in the art may understand that the present invention may be modified or changed without being deviated from the concept and the scope of the present invention disclosed in the following claims.

<The description of the reference numerals>

| | |
|---|---|
| 10: first actuator | 12: boom head chamber |
| 14: boom rod chamber | 20: second actuator |
| 22: bucket head chamber | 24: bucket rod chamber |

-continued

| <The description of the reference numerals> | |
|---|---|
| 100: first hydraulic pump | 110: second hydraulic pump |
| 200: main hydraulic line | 202: first center bypass line |
| 204: second center bypass line | 210: first parallel line |
| 220: second parallel line | 230: third parallel line |
| 232: boom head hydraulic line | 234: boom rod hydraulic line |
| 310: first control valve | 320: second control valve |
| 330: third control valve | 400: pilot pump |
| 402: control line | 410: first spool displacement adjusting valve |
| 420: second spool displacement adjusting valve | 430: third spool displacement adjusting valve |
| 500: controller | 510: data receiver |
| 520: priority mode determiner | 530: joystick displacement converter |
| 540: output portion | 600: manipulation portion |

The invention claimed is:

1. A control system for construction machinery, comprising:

a hydraulic pump;

first and second actuators connected to the hydraulic pump through first and second parallel lines respectively and operable by a working oil discharged from the hydraulic pump;

first and second control valves installed in the first and second parallel lines respectively and configured to control operations of the first and second actuators;

first and second spool displacement adjusting valves configured to supply pilot signal pressures to spools of the first and second control valves in proportion to inputted control signals to control displacement amounts of the spools of the first and second control valves; and a controller configured to output the control signals to the first and second spool displacement adjusting valves corresponding to manipulation signals of an operator for the first and second actuators, and configured to limit a spool displacement amount of the second control valve according to the manipulation signal for the first actuator when the manipulation signals are received, wherein the controller comprises a priority mode determiner configured to determine whether or not a priority mode where an operation of the first actuator is given to priority to be performed from the manipulation signals for the first and second actuators;

a joystick displacement converter configured to convert the manipulation signal of the operator for the second actuator to a secondary joystick displacement amount which is decreased in proportion to the manipulation signal of the operator for the first actuator, in the priority mode; and an output portion configured to output the control signal corresponding to the converted secondary joystick displacement amount for controlling the second pilot signal, and wherein the priority mode determiner determines to perform the priority mode in response to determining a working pressure of the first actuator being greater than a working pressure of the second actuator, and determines to cancel the priority mode in response to determining a discharge pressure of the hydraulic pump being greater than a predetermined pressure.

2. The control system for construction machinery of claim 1, wherein the controller is configured to decrease a conversion ratio of a spool displacement of the second control valve to the manipulation signal for the second actuator in proportion to a size of the manipulation signal for the first actuator.

3. The control system for construction machinery of claim 2, wherein when the manipulation signal for the first actuator is a maximum value, the conversion ratio of the manipulation signal for the second actuator is decreased to at least 50% of a conversion ratio in a single operation of the second actuator.

4. The control system for construction machinery of claim 1, wherein an orifice area of the second control valve is controlled to be in inverse proportion to the size of the manipulation signal for the first actuator.

5. The control system for construction machinery of claim 1, wherein the first and second spool displacement adjusting valves include an electro proportional pressure reducing valve (EPPRV).

6. The control system for construction machinery of claim 1, wherein the priority determiner cancels the priority mode in response to determining a heavy load work where the working pressures of the first and second actuators are greater than a predetermined pressure range being performed.

7. The control system for construction machinery of claim 1, wherein the first and second control valves are installed sequentially in a center bypass line connected to the hydraulic pump.

8. The control system for construction machinery of claim 7, wherein the first actuator includes a boom cylinder and the second actuator includes a bucket cylinder, and the first control valve includes a boom control valve and the second control valve includes a bucket control valve.

9. A control method for construction machinery, comprising:

providing a hydraulic system including first and second actuators connected to one hydraulic pump through first and second parallel lines respectively and first and second control valves installed in the first and second parallel lines respectively and configured to control operations of the first and second actuators;

receiving manipulation signals of an operator for first and second actuators;

determining whether or not a priority mode where an operation of the first actuator is given to priority to be performed from the manipulation signal; and limiting a spool displacement amount of the second control valve to the manipulation signal for the second actuator according to the manipulation signal for the first actuator, in the priority mode, wherein said determining whether or not the priority mode to be performed includes determining to perform the priority mode in response to determining a working pressure of the first actuator being greater than a working pressure of the second actuator, said receiving the manipulation signals of the operator for first and second actuators includes receiving joystick displacement amounts for the first and second actuators, said limiting the spool displacement amount of the second control valve includes converting an inputted joystick displacement amount for the second actuator to a secondary joystick displacement amount which is decreased in proportion to the joystick displacement for the first actuator, and the control method further comprises:

supplying a pilot signal pressure corresponding to the converted secondary joystick displacement amount to a spool of the second control valve to control a displacement amount of the spool of the second control valve; and canceling to perform the priority mode in response to determining a discharge pressure of the hydraulic pump being greater than a predetermined pressure.

10. The control method for construction machinery of claim 9, wherein limiting the spool displacement amount of the second control valve comprises decreasing a conversion ratio of the spool displacement of the second control valve to the manipulation signal for the second actuator in proportion to a size of the manipulation signal for the first actuator.

11. The control method for construction machinery of claim 10, wherein limiting the spool displacement amount of the second control valve comprises, when the manipulation signal for the first actuator is a maximum value, decreasing the conversion ratio of the manipulation signal for the second actuator to at least 50% of a conversion ratio in a single operation of the second actuator.

12. The hydraulic control method for construction machinery of claim 9, wherein limiting the spool displacement amount of the second control valve comprises controlling an orifice area of the second control valve to be in inverse proportion to the size of the manipulation signal for the first actuator.

13. The control method for construction machinery of claim 9, wherein supplying the pilot signal pressure to the spool of the second control valve comprises using an electro proportional pressure reducing valve (EPPRV).

14. The control method for construction machinery of claim 9, further comprising canceling to perform the priority mode in response to determining a heavy load work where the working pressures of the first and second actuators are greater than a predetermined pressure range being performed.

15. The control method for construction machinery of claim 9, wherein the first actuator includes a boom cylinder and the second actuator includes a bucket cylinder, and the first control valve includes a boom control valve and the second control valve includes a bucket control valve.

* * * * *